United States Patent [19]

Sheridan

[11] Patent Number: 4,900,027

[45] Date of Patent: Feb. 13, 1990

[54] GAME SCORING METHOD

[76] Inventor: John Sheridan, 2459 Century Hill, Los Angeles, Calif. 90067

[21] Appl. No.: 259,883

[22] Filed: Oct. 19, 1988

Related U.S. Application Data

[63] Continuation-in-part of Ser. No. 140,048, Dec. 31, 1987, abandoned.

[51] Int. Cl.[4] ..... G06F 15/44; A63F 1/18; A63B 71/06

[52] U.S. Cl. ..... 273/148 R; 273/1 ES; 273/85 CP; 273/292; 364/411

[58] Field of Search ..... 273/1 E, 1 ES, 148 R, 273/151, 85 CP, 292; 364/410, 411; 283/48.1, 49, 50

[56] References Cited

U.S. PATENT DOCUMENTS

| | | | |
|---|---|---|---|
| 797,548 | 8/1905 | Bates | 273/148 R |
| 1,354,151 | 9/1920 | White | 273/148 R |
| 1,558,838 | 10/1925 | Clark | 273/148 R |
| 2,016,767 | 10/1935 | Bower | 283/49 |
| 2,585,380 | 2/1952 | Greene | 273/148 R |
| 3,113,779 | 12/1963 | Guenther | 273/148 R |
| 3,486,754 | 12/1969 | Laubach | 273/148 R |
| 4,130,871 | 12/1978 | Olsen et al. | 273/148 R |
| 4,266,214 | 5/1981 | Peters, Jr. | 364/410 |
| 4,286,323 | 8/1981 | Meday | 364/411 |

FOREIGN PATENT DOCUMENTS

| | | | |
|---|---|---|---|
| 2830216 | 1/1980 | Fed. Rep. of Germany | 273/148 R |
| 2451759 | 11/1980 | France | 273/148 R |
| 2502815 | 10/1982 | France | 273/1 ES |
| 2526974 | 11/1983 | France | 364/411 |

*Primary Examiner*—Edward M. Coven
*Assistant Examiner*—Jessica J. Harrison
*Attorney, Agent, or Firm*—Gene W. Arant

[57] ABSTRACT

A method of scoring card games wherein digital numbers within a predetermined set or range which is not needed in scoring the particular game is reserved for player identification. In performing the method of the invention it is preferred to utilize a special purpose computer contained in a small carrying case, which has an operating keyboard and a visually activated scoreboard in side-by-side relation to the keyboard. The carrying case preferably has a hinged lid which is spring-loaded to normally remain in open position, operating instructions written on the inner side of the lid, and a latch for holding the lid closed. In operating the apparatus, a WE or THEY key is depressed before making player assignments by number. Scores subsequently recorded and visually displayed for each team are also stored in electronic memory for each individual player. Players change teams from one game to the next, but at the end of the play a total score for each individual player is produced in association with the identifying digital number that had been assigned to him.

3 Claims, 4 Drawing Sheets

Fig. 7.

GAME #1:

| WE (1,2) | THEY (3,4) |
|---|---|
| 50 | |
| 100 | 60 |
| 60 | |
| | |
| 210 | |
| 60 | 60 |
| 150 | ZERO |

GAME #2:

| WE (1,3) | THEY (2,4) |
|---|---|
| | |
| 40 | |
| 60 | |
| | 100 |
| | 80 |
| 100 | 180 |
| 100 | 100 |
| ZERO | 80 |

SCORES:

| |
|---|
| #1 |
| 150 |
| ZERO |
| 150 |
| #2 |
| 150 |
| 80 |
| 230 |
| #3 |
| ZERO |
| ZERO |
| ZERO |
| #4 |
| ZERO |
| 80 |
| 80 |

GAME SCORING METHOD

RELATED APPLICATION

This application is a continuation-in-part of my prior copending application Ser. No. 07/140,048 filed 12/31/87 now abandoned.

BACKGROUND OF THE INVENTION

In the playing of various card games it is advantageous to have an automatic machine or device to assist in the score keeping. As the playing progresses, in some instances there is a change of partners, and it is then necessary to keep individual scores for the various individual players. This tends to make the task of keeping the scores more complex.

If an effort is then made to utilize the assistance of an automatic machine or device, there are many different ways to approach both the problem and its solution.

PRIOR ART

Pertinent prior art includes U.S. Pat. No. 4,130,871 to Olsen et al which discloses an electronic computer that is designed to keep track of the bidding and scoring of bridge games. Other prior art includes:

U.S. Pat. Nos.

4,030,764 Mattos
3,420,526 Berger
4,380,334 Minkoff et al
4,368,516 Morin
4,286,323 Meday
4,266,214 Peters, Jr.
3,569,686 Comorau
1,613,975 Bartlett et al
D 243,250 Hazama French Patents 2451-759 (1980)
2526-974-A (1983)
2534-481-A (1984)

German Patents 2830-216 (1980)
3003-376 (1981)

SUMMARY OF THE INVENTION

The present invention provides a novel method of keeping track of scores, in that digital numbers within a predetermined low range of numbers are reserved solely for the identification of players, while all digital numbers above that predetermined range are reserved for scoring purposes. According to the invention each player has an identifying number assigned to him or her, and must then remember that number — a computer is preferably used, but the machine does not record the names of players. Whenever a number within the predetermined range is inputted into the computer keyboard it indicates either that a particular player is being assigned to a particular playing team, or else that a scoring transaction is applicable to that particular player.

According to the invention, the computer is not used for keeping track of bids. Only numerical inputs are used in the machine — it does not have any alphabetical capability except for WE and THEY team designations.

Further according to the invention, each separate "game" score is displayed, then stored in electronic memory in a non-visible form while subsequent "games" are being played. Players are changed from one game to the next. The machine also accumulates the scores of the series of "games" in order to keep track of the accumulated score for each individual player.

A recall feature permits recalling the scores of earlier individual "games" for visual display.

In one preferred embodiment the principles of the invention are illustrated in their application to scoring the game of bridge. In another embodiment the scoring of gin rummy is illustrated.

Although the novel method of the present invention may be carried out by hand, it is preferred to utilize a portable, conveniently packaged special-purpose electronic computer. In an electrical sense the computer may utilize conventionally available computer components including central processing unit, input keyboard mechanism, and visual output display.

In a mechanical sense it is preferred to utilize a flat compact device including a main housing having a hinged lid which is also latchable, an input keyboard contained within the main housing, an electronic computer controlled from the keyboard, and visual output display means providing a scoreboard in the main housing in side-by-side relation to the keyboard and controlled from the computer. Preferably, operating instructions are written on the inner surface of the hinged lid so that they are easily seen when the lid has been raised and the computer is being used. In essence the device is similar to a lady's "compact", and it is in fact adapted to be carried in a lady's purse.

DRAWING SUMMARY

FIG. 7 is a chart which illustrates the scoring of a bridge game by hand in accordance with the novel method of the present invention.

BRIDGE SCORING APPARATUS

Reference is now made to FIGS. 1–6 of the drawings which illustrate the apparatus of the present invention which is especially adapted to the scoring of bridge games.

The apparatus A includes a main housing H with a closable lid L, and various internal mechanisms. The housing and lid will be described first.

Figure 2:
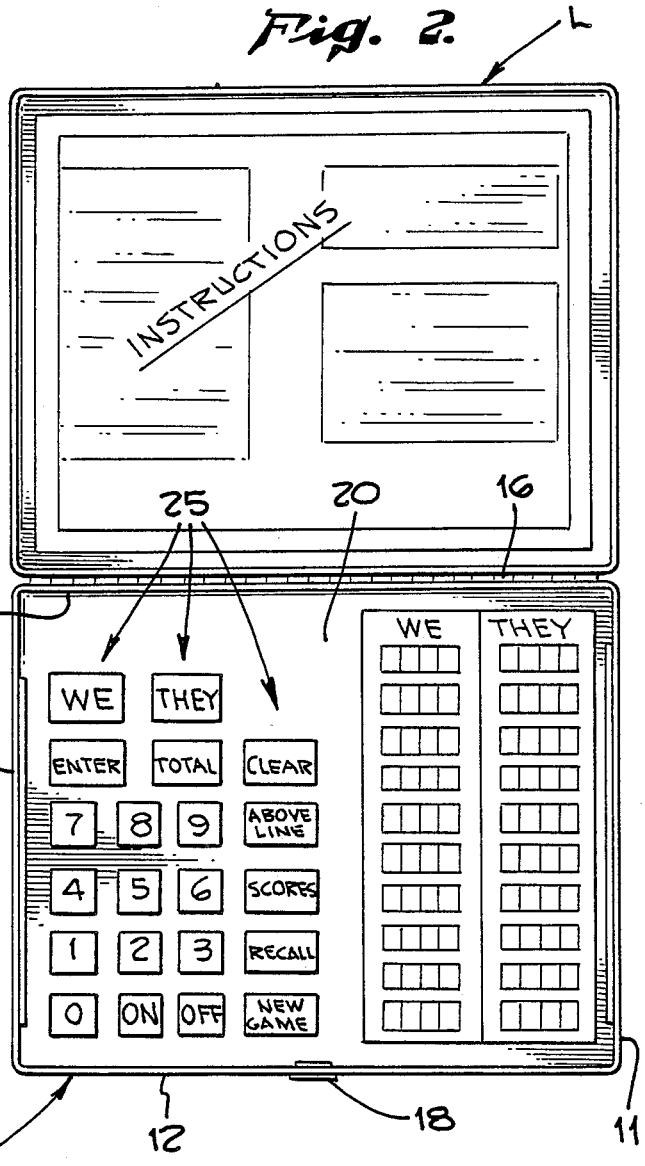
FIG. 2 is a top plan view of the apparatus with the lid open and the operating parts exposed.

Housing H is a flat rectangular box-like structure having a flat bottom wall 10 and upstanding side and end walls. As seen in FIG. 2 the right-hand end wall is designated as 11 and the left-hand end wall as 13. Longitudinal side wall 12 is seen at the front side of the housing while side wall 14 is seen at the rear side.

Figure 1:
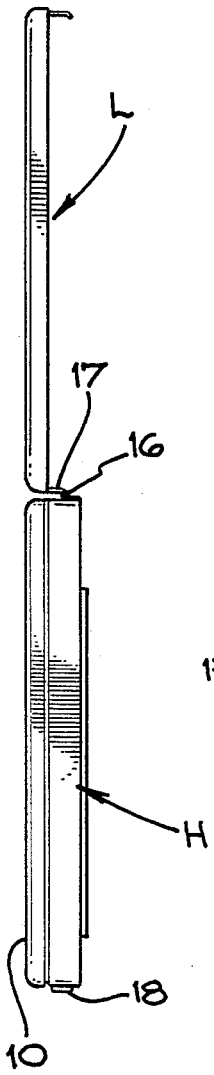
FIG. 1 is an end view of an apparatus used in accordance with the invention for scoring bridge games, with the lid in open position, the closed position of the lid also being shown but in phantom lines.
Figure 6:
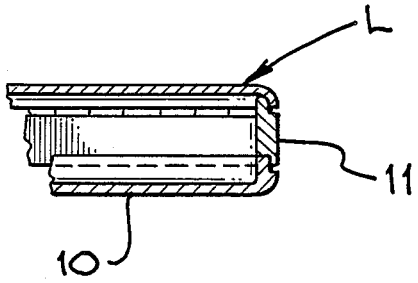
FIG. 6 is a cross-sectional view taken on the line 6—6 of FIG. 4 showing structural details of the housing and lid.

Lid L is also of rectangular configuration with shallow side and end walls which fit over the corresponding walls of housing H when the lid is in its closed position; see FIG. 6 which illustrates this detail. A hinge 16 supports the lid L from side wall 14 of housing H, see FIG. 1. Spring means 17, not specifically shown, is associated with housing wall 14 and with the adjacent edge of lid L for normally retaining the lid in its open position as shown in FIGS. 1 and 2.

Housing H may typically have a length of 5 9/16 inches and width of 4 5/16, and when lid L is closed the apparatus may have a height or thickness of $\frac{3}{4}$ inch.

Figure 3:
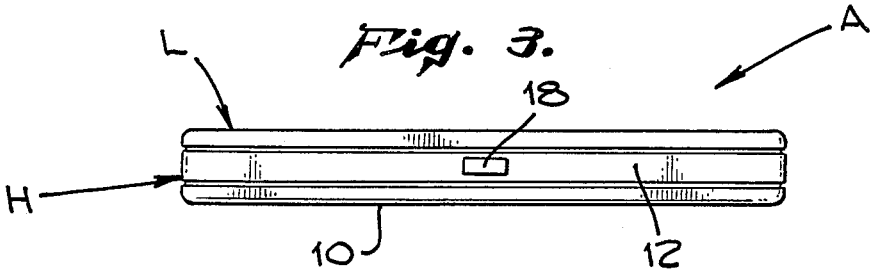
FIG. 3 is a front elevation view of the apparatus of FIG. 1 with the lid closed.
Figure 4:
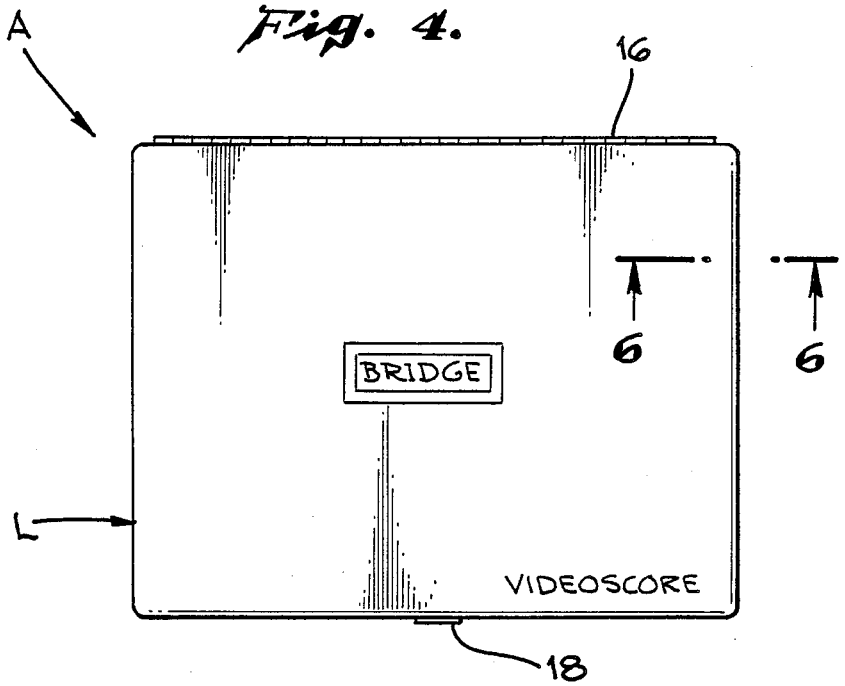
FIG. 4 is a top plan view of the apparatus of FIG. 1 with the lid closed.

For carrying purposes the lid L is closed and is latched in position by means of a latch 18, see FIGS. 2 and 3. The latch is preferably of a type which has a small plate that is pushed inward in order to release the latch mechanism — then the lid L springs open under force of the spring 17.

Figure 5:
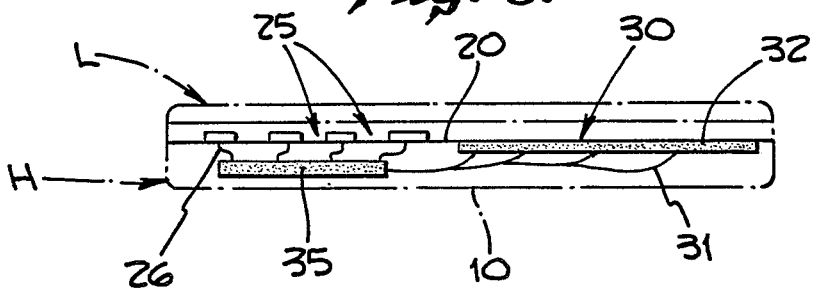
FIG. 5 is a cross-sectional elevation view taken on line 5—5 of FIG. 4, shown in a schematic form only.

A flat support plate 20 is contained within housing H in parallel relation to bottom wall 10, see FIG. 5. An electronic computer 35 which may typically be a single-chip microprocessor is contained in housing H underneath support plate 20. Above the support plate 20 on the left side, as seen in FIG. 2, is a keyboard which is generally identified by the numeral 25, while on the right side there is a scoreboard generally identified by numeral 30. Keyboard 25 provides inputs to computer 35 via keyboard circuits 26, while computer 35 controls the scoreboard 30 through display circuits 31. As shown in FIG. 5, the scoreboard 30 is constructed from a panel 32 of liquid crystal diodes (LCD's).

According to the invention INSTRUCTIONS are preferably written on the inner surface of lid L so that they are easily seen when the lid is open. See FIG. 2. Such INSTRUCTIONS may relate to the rules of the game to be played, or to the method of operating the computer for purpose of keeping score, and will preferably relate to both.

BRIDGE SCORING METHOD USING THE COMPUTER

Keyboard 25 contains keys that fall into three distinct categories; the WE and THEY keys indicating teams of players; the numerical keys 1 through 9, inclusive; and the command keys. The various command keys and their functions will now be described.

The purpose of the ON and OFF keys is to turn the computer on or off, respectively. For the purpose of the present invention it is not crucial whether some portion of the computer utilizes a volatile memory which will lose its information when power is shut off, because according to the invention the computer will preferably be kept turned on continuously throughout a particular card playing session.

The NEW GAME key is used to indicate that a new game is being started. This causes the scores for any previous game to disappear from the scoreboard although remaining stored electronically in memory. Then if it is desired to recall the scores of the previous game, that may be done by pressing the RECALL key.

The purpose of the ENTER key is to cause information to be entered into the computer memory which has previously been selected by the WE and THEY keys and/or the numerical keys.

The CLEAR key is used to correct an entry error; it causes the last entry to be deleted, and restores the previous information in the computer.

The main function of the WE and THEY keys is fairly apparent; any score to be entered for either team is first preceded by the WE or THEY instruction. Another function is less obvious, which is the assignment of players to each team. According to the invention the computer does not record the names of players; rather, a number in the value range of 1 to 9, inclusive, is assigned to each player, and then the computer is informed by player number as to which players are on each team.

More specifically, the player assignment is accomplished as follows. Suppose the two players for the WE team are players #6 and #8. A new game is being started. The NEW GAME key is depressed. The WE key is depressed, the #6 key is depressed, and then the ENTER key is depressed. This stores in the computer the information that player No. 6 is a member of the WE team. Then the WE key is again depressed, the #8 key is depressed, and the ENTER key is depressed, which then stores in the computer the information that player No. 8 is also a member of the WE team.

At the end of each hand that is played the score is entered by pushing either WE or THEY as appropriate, plus numerical keys for the score value, plus the ENTER key; the score is then entered below the line for that team of players. If a score is to be entered above the line the ABOVE LINE key is depressed before depressing the ENTER key.

The computer continues to enter scores below the line in response to the ENTER key, and above the line in response to the ABOVE LINE key plus ENTER key, until instructed otherwise. Such other instruction is given by depressing the TOTAL key. This will cause the scores for the two teams to be totalled, giving one team a net positive score on the scoreboard, and the other team an equal negative score on the scoreboard. At the same time that these scores are displayed on the scoreboard, the computer in its memory also assigns the same scores to the respective individual players, capable of being called up by the SCORES key.

The SCORES key is not used to enter score information into the computer, but only when it is desired to call up the scores of the various individual players for display on the scoreboard.

It should be noted here that the use of the low numbers within a predetermined range of numbers to identify players is compatible with the other use of the number keys, namely, to enter scores, because none of the scores in a bridge game will have a numerical value less than 10. It is desirable to enter the identity of the two players separately because this simplifies the computer programming; however if desired, the WE team may be identified simply as 68 and the computer may then be programmed to distinguish this two-digit number from all possible two-digit numbers that will represent scores.

In electronic terms, depressing the WE key causes a first signal to be generated, and depressing the #6 key causes a second signal to be generated. When the ENTER key is then depressed, it causes these two separate signals to form a composite signal set, and also causes that composite signal set to be stored in memory. Subsequently, when a score is entered for the WE team, the computer in its memory records that score both for the team and for each individual player on that team. At this time the first signal for WE is again generated, a third separate signal (or set of signals) is generated for the score, and depressing the ENTER key causes a second composite signal set to be stored in memory in association with the first composite signal set previously stored there.

Although the visual display on the scoreboard at the end of each game shows only the score for each team, the computer in its memory also stores the scores for each individual player. The pressing of the SCORES key will cause the computer to add up and visually display the total score accumulated in that playing session by each individual player, when and as each player is designated before pressing the SCORES key.

A more detailed and perhaps more precise description of the operation of the computer is set forth on the following pages where various operating steps are listed in a somewhat more mathematical fashion. Here it is assumed that Chicago Bridge is being played, where four hands constitute a game, and scores are reported in both positive and negative numbers.

BRIDGE

| PLAYERS - | KEY | COMPUTER RESPONSE - | SCREEN |
|---|---|---|---|
| 1. Turn on computer. | [On] | Computer turns on,<br>Enters zero value in -<br>Players identity numbers,<br>Sub-totals "S",<br>Totals "T",<br>Scores "R",<br>Difference "D". | We They |
| 2. Draw for partners,<br>Identify players by number,<br>List players in computer by side and number. | [We]#[Enter]<br>[We]#[Enter]<br>[They]#[Enter]<br>[They]#[Enter]<br>Etc. | If# ≦ 9,<br># is entered to identify player's number and side. | |
| 3. Deal, auction, play,<br>Count tricks,<br>Enter scores below line. | [We]#[Enter]<br>or<br>[They]#[Enter] | If # > 9,<br># is screened "below line" (blinking).<br># is added to appropriate sub-total "s",<br>If "S" > 100,<br>Line is screened below #'s,<br>"S" is added to total "T",<br>"S" becomes zero,<br>Screened numbers cease blinking. | We They<br>* * * *<br>* * |
| 4. Enter premium scores above line. | [We]#[Above line]<br>And/Or<br>[They]#[Above Line] | # is screened above line,<br># is added to appropriate total "T". | We They<br>* *<br>* * * *<br>* * * |
| 5. After last deal is played and scored,<br>Ask result. | [Total] | Adds sub-totals "S" to totals "T" on each side,<br>"S" becomes zero,<br>Draws line below numbers,<br>Compares totals - "T" We and "T" They,<br>Screens larger total (on own side),<br>Screens smaller total (on large total side),<br>Draws line below totals,<br>Subtracts small total from large total,<br>Difference "D" is screened below last line,<br>Adds "D" to each "larger total" side player's score "R",<br>Subtracts "D" from each "smaller total" side player's score "R". | We They<br>* *<br>* * * *<br>* * * *<br>* * |
| 6. Ask for player's scores | [Score] | Shows player's numbers with "R" values on screen. | 1 * *<br>2 * *<br>3 * * *<br>4 * |
| 7. To recall previous games. | [Recall] | Recalls and shows on screen previous game,<br>Repeating command steps back game by game and returns to last game,<br>i.e. #5 #4 #3 #2 #1 #5. | |
| 8. To start new game.<br>Then -<br>Restart at Step 2. | [New Game] | Enters last game in memory #5,<br>Moving all other games to one lower memory and deleting game that was in memory #1.<br>Zero value is entered for -<br>Player's identity numbers,<br>Sub-totals "S",<br>Totals "T",<br>Difference "D".<br>No change is made in scores "R". | |
| 9. To correct an entry error. | [Clear] | Successively deletes last entry,<br>Deleted values would be replaced by previous values, held in sequence memory. | |
| 10. To turn off computer. | [Off] +<br>[Above Line]<br>(Together) | Turns off power. | |

BRIDGE SCORING METHOD ON PAPER

Reference is now made to the chart of FIG. 7 which illustrates the novel method of the present invention when using paper and pencil for scoring the bridge game.

In the illustration of FIG. 7 it is assumed that a series of two card games will be played, during which the teams of partners are changed from one game to the next. An objective of the method is to score both the separate game scores for each team and the final cumulative score for each individual player.

A first step is to select for each individual player a digit which lies within the range 1 to 9, inclusive, and which will then represent that player for score-keeping purposes. Thus, the four players are assigned #1, #2, #3, and #4, respectively.

Then when the first game is to commence, a first pair of players #1 and #2 are assigned to a "WE" team, while a second pair of players #3 and #4 are assigned to a "THEY" team. These player assignments are written on the score paper under the heading "Game #1". That is, in conjunction with a "WE" symbol the digits #1 and #2 previously selected to represent the first pair of players are written down, and in conjunction with a "THEY" symbol the digits #3 and #4 previously selected to represent the second pair of players are written down.

As the first game progresses, a digital number corresponding to the score for each successive hand is recorded in association with the previously recorded "WE" or "THEY" symbol, as appropriate. In the example it is assumed that four hands constitute a game. In one hand the THEY team fails to make its bid, resulting in a score of 50 above the line for the WE team. In other hands the WE team makes bid scores of 100 and 60, respectively, while the THEY team makes a bid score of 60.

At the conclusion of the first game, digital numbers representing scores for the various hands are added up to provide game total scores for the "WE" and "THEY" teams, which are then written down in association with the previously recorded "WE" and "THEY" symbols, respectively.

It will be noted that in the example of FIG. 7 a different scoring convention is used than was described previously. That is, the WE team is assigned a game score of 150 and the THEY team is assigned a game score of ZERO, rather than −150.

Before starting the second game the team assignments are changed. Player #3 is assigned to the WE team while player #2 is assigned to the THEY team.

Under the "Game #2" heading the team symbols "WE" and "THEY" are recorded again, but in new locations, and in association with each team symbol the digits representing the individual players now assigned to that team are also written down.

As the second game progresses, digital numbers corresponding to the scores for the successive hands are recorded in association with the previously recorded "WE" or "THEY" team symbol, as appropriate, in the same manner as it was done during the first game.

At the conclusion of the second game, scores for the various hands are added up and digital numbers representing the new game scores for the "WE" and "THEY" teams are written down in association with the new recordings of the team symbols "WE" and "THEY", respectively. Thus, the WE team is assigned a total score of ZERO for the second game, while the THEY team is assigned a total score of 80.

Then, for each individual player, all the scores for both games associated with the digit which represents that individual player are added up, to thereby provide a total score for that individual player. These totals are then written down. Thus, in association with digit #1 which represents one individual player a total score of 150 is written down; in association with digit #2 which represents another individual player a total score of 230 is written down; in association with digit #3 representing the third player a total score of ZERO is written down; and in association with digit #4 representing the fourth player a total score of 80 is written down.

At the conclusion of this scoring procedure it is necessary for each individual player to remember his player number in order to know what his total score is.

While not presently illustrated, it is evident that, for example, a group of six players may engage in competitive playing of a series of three games. Two of the players sit out the first game, a different two players sit out the second game, and those who played both of the first two games will sit out the third game. Then the total scores of the individual players are added up in the same manner as indicated in FIG. 7.

SCORING OF GIN RUMMY

Figure 8:
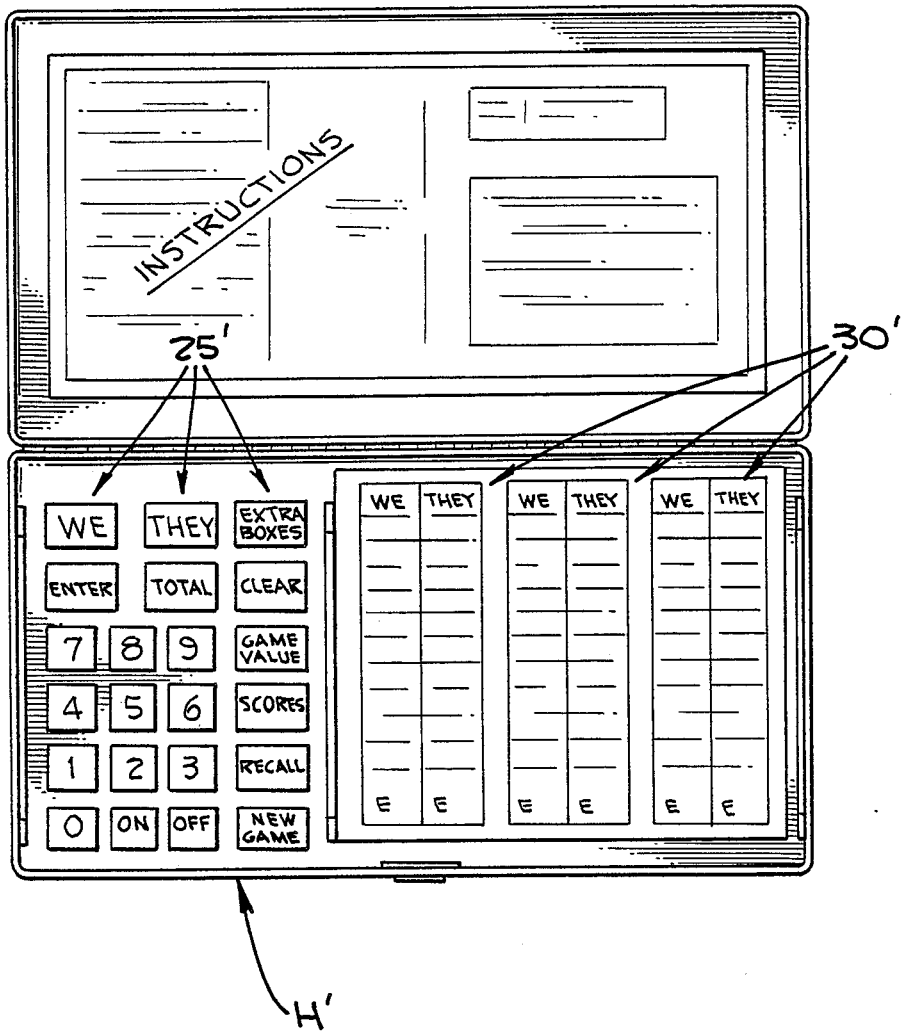
FIG. 8 is a view like FIG. 2, but showing a modified form of computer adapted for scoring gin rummy.

Reference is now made to FIG. 8 illustrating the application of the invention to gin rummy. The arrangement of the scoreboard 30' is somewhat different, with three scoring columns instead of one. The physical length of the housing H' is therefore somewhat greater. The command keys on keyboard 25' are also somewhat different, being adapted to a different card game. A detailed description of the operating steps is set forth on the following pages.

GIN RUMMY

| PLAYERS - | KEY | COMPUTER RESPONSE - | SCREEN |
|---|---|---|---|
| 1. Turn on computer. | [On] | Computer turns on,<br>Zero value is entered for -<br>Player's Identity numbers,<br>Sub-total "S",<br>Totals "T",<br>Game Value "G",<br>Scores "R",<br>Extra Boxes "E". | |
| 2. Draw for partners,<br>Identify players by number,<br>List players in computer<br>by side and number. | [We]#[Enter]<br>[We]#[Enter]<br>[They]#[Enter]<br>[They]#[Enter]<br>Etc. | If "G" = 0,<br># is entered to identify player's<br>number and side. | |
| 3. Decide and enter "Game Value". | #[Game Value] | # is entered in "G". | |
| 4. Deal, | [We]#[Enter] | If "G">0, | |

-continued

GIN RUMMY

| PLAYERS - | KEY | COMPUTER RESPONSE - | SCREEN |
|---|---|---|---|
| Play,<br>Enter score. | or<br>[They]#[Enter] | # is added to appropriate sub-total"s",<br>Sub-total "S" are shown on screens in blinking numbers. | |
| 5. Enter extra boxes scored. | [We]#[Extra Boxes]<br>or<br>[They]#[Extra Boxes] | # is added to extra boxes totals "E",<br><br>"E" is shown at bottom of screens in "E" row. | |
| 6. After last pair's score is entered,<br>Ask for result. | [Total] | Sub-totals "S" are compared,<br>Larger sub-total is made equal to the difference between we and they sub-totals,<br>Smaller sub-total is made equal to zero,<br>Larger sub-total is added to total "T",<br>Blinking sub-totals are replaced on screen with 'Steady Figure ' value of "T",<br>Larger sub-total is made equal to zero,<br>"T" is then compared to 'Game Value' "G".<br>If "T" ≧"G",<br>Line is drawn under total "T" on screen,<br>Game value "G" is shown on screen below line,<br>"G" is added to total "T",<br>*Number of We/They 'totals' above line is compared, and difference × 25 is entered in "D",<br>Value of "E" × 25 is then added to "D",<br>"D" is shown on screen below "G",<br>Line is drawn on screen below "D",<br>"D" is added to total "T",<br>"T" is shown on screen below line,<br>("D" may be + or − value). | W T<br>* * * *<br>* * *<br>W T<br>* * * *<br>* * * *<br>* * *<br>W T<br>* * * *<br>* * * *<br>* * * * * *<br>* * * |
| 7. | | *If (in Step 6) one We/They 'totals' number = zero,<br>"T" becomes 2 × "T" and is final 'total',<br>"T" is shown on screen below line. | |
| 8. | | "T" is added to each player's score "R".<br>(Summation of all + and − "R"s must = 0) | |
| 9. To recall previous games. | [Recall] | Recalls and shows on screen previous game,<br>Repeat command steps back game by game and returns to Game 5, i.e. #5, #4, #3, #2, #1, #5. | |
| 10. To start new game. | [New Game] | Enters last game in Memory #5,<br>Moves all other games to one lower memory #,<br>Deletes game in Memory #1,<br>Zero value is entered for -<br>Player's Identity numbers,<br>Sub-totals "S",<br>Totals "T",<br>Boxes value "D",<br>New Boxes "E",<br>(No change is made in 'Score' value "R", or in 'Game Value' G"). | |
| Then -<br>Restart at Step 2. | | | |
| 11. To correct an entry error | [Clear] | Successively deletes last entry,<br>Deleted values would be replaced by previous values, held in sequence memory. | |
| 12. Ask for player's scores. | [Scores] | Shows player's numbers with score "R" values on screen. | 1 * *<br>2 *<br>3 * * *<br>4 * * |
| 13. Return to game. | [Scores] | Returns screen to game values. | |
| 14. To turn off computer. | [Off]+<br>[Game Value]<br>(Together) | Turns off power. | |

The invention has been fully illustrated in at least one of its forms in order to comply with the requirements of the patent law. Many variations are of course possible, and the scope of the invention is therefore to be limited only by the appended claims.

I claim:

1. In the playing of a series of two or more card games, during which the teams of partners are changed from one game to the next, a method of scoring both the separate game scores for each team and the final cumulative score for each individual player, comprising the steps of:

first selecting for each individual player a digital number which lies within a predetermined low range of numbers that are below the range of numbers which will be needed for scoring, and which digital number will then identify that player for score-keeping purposes;

when the first game is to commence, (a) assigning a first pair of players to a "WE" team and a second pair of players to a "THEY" team, (b) recording in conjunction with a "WE" symbol the respective digital numbers previously selected to represent said first pair of players, and (c) recording in conjunction with a "THEY" symbol the respective digital numbers previously selected to represent said second pair of players;

as the first game progresses, recording a digital number corresponding to the score for each successive hand, in association with the previously recorded "WE" or "THEY" symbol, as appropriate;

at the conclusion of the first game, recording digital numbers representing game total scores for the "WE" and "THEY" teams, in association with the previously recorded "WE" and "THEY" symbols, respectively;

then changing the team assignments for the second game, by assigning at least one different player to at least one team;

again recording the team symbols "WE" and "THEY", but in new locations, and recording in association with each team symbol the digital numbers representing the individual players now assigned to that team;

as the second game progresses, recording a digital number corresponding to the score for each successive hand, in association with the previously recorded "WE" or "THEY" symbol, as appropriate;

at the conclusion of the second game, recording digital numbers representing the new game scores for the "WE" and "THEY" teams, in association with the new recordings of the team symbols "WE" and "THEY", respectively; and thereafter, for each individual player, adding up all the scores for both games associated with the digital number which identifies that individual player, to thereby provide a total score for that individual player, and then recording that total score in association with the digital number which identifies that individual player.

2. The method of claim 1 wherein said low range of numbers used for identifying players is in the range 1 to 9, inclusive.

3. The method of scoring a card game utilizing an electronic computer that has WE, THEY, ENTER, and digit 0 through 9 keys, which consists of assigning to each player an identifying digital number within the range 1 through 9, entering in conjunction with the WE key the identifying numbers of a pair of players who have been assigned to the WE team, entering in conjunction with the THEY key the identifying numbers of a pair of players who have been assigned to the THEY team, thereafter entering in conjunction with the WE and THEY keys digital numbers indicating scores earned by the WE and THEY teams, respectively, and finally causing the computer to add up and display a total score for each individual player in conjunction with the particular identifying digit 1 through 9 which had been assigned to that individual player.

* * * * *